US006169931B1

(12) United States Patent
Runnels

(10) Patent No.: US 6,169,931 B1
(45) Date of Patent: Jan. 2, 2001

(54) METHOD AND SYSTEM FOR MODELING, PREDICTING AND OPTIMIZING CHEMICAL MECHANICAL POLISHING PAD WEAR AND EXTENDING PAD LIFE

(75) Inventor: Scott R. Runnels, San Antonio, TX (US)

(73) Assignee: Southwest Research Institute, San Antonio, TX (US)

( * ) Notice: Under 35 U.S.C. 154(b), the term of this patent shall be extended for 0 days.

(21) Appl. No.: 09/124,339

(22) Filed: Jul. 29, 1998

(51) Int. Cl.[7] ..... G06F 19/00

(52) U.S. Cl. ..... 700/97; 700/121

(58) Field of Search ..... 700/97, 121, 164

(56) References Cited

U.S. PATENT DOCUMENTS

| | | | | |
|---|---|---|---|---|
| 4,833,617 | | 5/1989 | Wang | 364/474.15 |
| 5,356,513 | * | 10/1994 | Burke et al. | 156/636 |
| 5,367,465 | | 11/1994 | Tazawa et al. | 364/468 |
| 5,471,403 | | 11/1995 | Fujimaga | 364/488 |
| 5,486,129 | * | 1/1996 | Sandhu et al. | 451/5 |
| 5,510,652 | * | 4/1996 | Burke et al. | 257/752 |
| 5,514,245 | | 5/1996 | Doan et al. | 156/636.1 |
| 5,526,293 | | 6/1996 | Mozumder et al. | 364/578 |
| 5,599,423 | * | 2/1997 | Parker et al. | 156/636.1 |
| 5,637,031 | | 6/1997 | Chen | 451/41 |
| 5,655,110 | | 8/1997 | Krivokapic et al. | 395/500 |
| 5,665,202 | | 9/1997 | Subramanian et al. | 438/692 |
| 5,759,918 | * | 6/1998 | Hoshizaki et al. | 438/692 |
| 5,836,807 | * | 11/1998 | Leach | 451/41 |

OTHER PUBLICATIONS

M. Bhusan et al., "Chemical–Mechanical Polishing in Semi-direct Contact Mode", J. Electrochem. Soc. (Nov. 1995), vol. 142, No. 11, pp. 3845–3851.

R. Jairath et al., "Role of Consumables in the Chemical Mechanical Polishing (CMP) of Silicon Oxide Films", SEMATECH Paper.

P. Renteln et al., "Characterization of Mechanical Planarization Processes", VMIC Conference, Jun. 1990, pp. 57–63.

J. Warnock, "A Two Dimensional Process Model for Chemi-mechanical Polish Planarization", J. Electrochem. Soc.(Aug. 1991), vol. 138, No. 8, pp. 2398–2402.

S. Sivaram et al., "Measurement and Modelling of Pattern Sensitivity During Chemical Mechanical Polishing of Inter-level Dielectrics", SEMATECH Paper, Conference Proceedings ULSI–VII (1992) Materials Research Society, pp. 511–517.

S. Runnels, "Advances in Physically Based Erosion Simulators for CMP", J. of Electronic Materials (1996), vol. 25, No. 10, pp. 1574–1580.

M. Ruttan et al., "Pattern Density Effects in Tungsten CMP", Semiconductor International (Sep. 1995) pp. 123–128.

(List continued on next page.)

*Primary Examiner*—Thomas C. Lee
*Assistant Examiner*—Nitin Patel
(74) *Attorney, Agent, or Firm*—Taylor Russell & Russell, P.C.

(57) ABSTRACT

A computer implemented system and method for modeling, predicting and optimizing a Chemical Mechanical Polishing (CMP) system for polishing semiconductor wafers and other types of substrates used in the manufacture of integrated circuits. The method and system comprises a pad wear and conditioning model that predicts the polishing effectiveness of each sampling point on the polish pad based upon the polishing pad and substrate parameters, the pressure and speed between the wafer and the polish pad, and on the amount of polishing the point has performed in a simulated CMP hardware configuration using the CMP system recipe settings. The model determines the change in pad roughness and thickness for each sampling point on the pad. The model results are used along with wafer scale uniformity and feature scale planarity model results to optimize pad life and determining optimal recipe settings for the CMP process.

29 Claims, 7 Drawing Sheets

OTHER PUBLICATIONS

R. Jairath et al., "Consumables for the Chemical Mechanical Polishing (CMP) of Dielectrics and Conductors", Mat. Res. Soc. (Spring 1994), Invited Paper.

R. Sivaram et al., "Chemical Mechanical Polishing of Interlevel Dielectrics: Models for Removal Rate and Planarity", Mat. Res. Soc. Symp. Proc. vol. 260 (1992), pp. 53–64.

M. Desai et al., "Chemical Mechanical Polishing for Planarization in Manufacturing Environment", Mat. Res. Soc. Symp. Proc. vol. 337 (1994), pp. 99–104.

A. Hu et al., "Concurrent Deployment of Run by Run Controller Using SCC Framework", 1993 IEEE/SEMI Int'l Semiconductor Manufacturing Science Symp. pp. 126–132.

B. Stine et al., A Closed–From Analytic Model for ILD Thickness Variation in CMP Processes, 1997 CMP–MIC Conference, pp. 266–272.

V. H. Bulsara et al., "Mechanics of Polishing", Transactions of the AMSE, vol. 65, Jun. 1998, pp. 410–416.

O. G. Chekina et al., "Wear–Contact Problems and Modeling of Chemical Mechanical Polishing", J. Electrochem. Soc., vol. 145, No. 6, Jun. 1998, pp. 2100–2106.

H. Kim et al., "The Effect of the Pattern Sensitivity on Interlayer Dielectric Planarization", 1998 CMP–MIC Conference, pp. 103–109.

W.–T. Tseng et al., "Distribution of Pressure and Its Effects on the Removal Rate During Chemical–Mechanical Polishing Process", 1998 CMP–MIC Conference, pp. 87–94.

J. Grillaert et al., "Modeling Step Height Reduction and Local Removal Rates Based on Pad–Substrate Interactions", 1998 CMP–MIC Conference, pp. 79–86.

* cited by examiner

METHOD AND SYSTEM FOR MODELING, PREDICTING AND OPTIMIZING CHEMICAL MECHANICAL POLISHING PAD WEAR AND EXTENDING PAD LIFE

BACKGROUND

This invention relates generally to Chemical Mechanical Polishing (CMP) processes for planarizing and polishing the substrates used in the manufacture of integrated circuits. More particularly, the invention is a method and system for modeling, predicting and optimizing the performance of the CMP polishing medium, called polishing pads, and thus predicting pad wear and extending pad life. The present method and system integrates uniformity, planarity, and pad conditioning and wear models to predict CMP polishing pad performance and then uses the resulting predictions to optimize CMP polishing pad performance and extend pad life.

Chemical mechanical polishing (CMP) is a method of removing material from the surface of semiconductor wafers and other types of substrates used in the manufacture of integrated circuits. For the purposes of simplifying the discussion, the term wafer is used to denote the workpiece undergoing the CMP process. However, other types of substrates that utilize CMP processes can be used interchangeably with the term wafer. In the CMP process, the semiconductor wafer is placed on a wafer carrier and pressed face-down on a rotating platen holding a polishing pad. The polishing pad typically has two layers: a relatively stiff upper pad and a relatively soft base pad. A slurry with an abrasive material (for example, silica particles of size 10–200 nm) held in suspension is dripped onto the rotating platen and pad during polishing. The carrier and platen rotate at variable speeds, typically on the order of 30 rpm. The number of wafers that may be simultaneously polished varies: single-wafer, dual-wafer, and five-headed polishing systems currently exist.

The CMP process removes material at the surface of the wafer through this combination of mechanical and chemical action. The CMP process is performed at various stages in the fabrication of devices on a substrate. The planarization of dielectric (silicon dioxide) layers between multilevel metallization steps is one common application. CMP is used to planarize these interlevel dielectric (ILD) materials, which have patterns on them that result from being deposited over patterned metal lines. CMP is also used to polish metal films such as tungsten and copper by completely removing them except for that which remains in trenches purposely pre-etched in the underlying ILD. The goal of the CMP process is to uniformly remove material from the surface of the wafer to achieve wafer-scale uniformity. In silicon dioxide, small features are also removed to achieve feature-scale planarity. In polishing metal films, the CMP process attempts to preserve small features that are pre-etched in the underlying ILD.

Because the CMP polishing pad is a major component in the CMP process, analyzing its changing properties and characteristics throughout the polishing process is especially important in understanding and predicting uniformity and planarity of the polished wafer. Since the CMP process includes mechanical abrasion of the surface, the polishing pad wears rapidly. This is often referred to as pad degradation, which corresponds to the gradual decay of removal rate of the material from the wafer surface. The decay in removal rate is due to the decrease in roughness of the abrasive surface of the pad as the pad degrades with use.

In order to minimize pad degradation, pad conditioning is usually employed whereby the abrasive surface of the pad is restored, either by mechanical damage to the surface or removal of a thin surface layer. Although this helps to roughen the pad and temporarily restore the material removal rate, pad conditioning decreases the thickness of the pad, which in turn decreases pad life. Two key physical properties affect pad life: the thickness of the top pad and the compressibility of the base pad, both of which change with use. Repeated use and conditioning reduces the top pad thickness and repeated cyclical loading reduces the base pad compressibility. Pad thinning results in a reduced planarization rate, which ultimately ends pad life.

Since the pad degrades over time as it is used for polishing and the removal rate of the semiconductor material varies based in part on pad age and wear, wafer-to-wafer uniformity is difficult to predict. It is even difficult to achieve and maintain uniform material removal within the same wafer because the polishing pad removal rate may not be constant over the wafer due to changes in pad thickness and roughness. As the pad is conditioned as part of the CMP process, the top layer of the pad that contacts the wafer is roughened, meaning material is removed and the pad becomes thinner and correspondingly less stiff. The softer base pad layer of the pad is compressed due to the downforce of the wafer and also becomes thinner over time. Changes in the pad roughness and thickness may also be due in part to the differences between the polishing action or rate at the center and edge of the wafer that may arise due to a number of factors including wafer asymmetry, non-constant relative pad velocity from the edge of the wafer to the center, non-uniform slurry and by-product transport under the wafer, wafer bowing due to pressure, or machine drift in time of any of these parameters.

Since CMP is now the preferred method of removing material from the surface of semiconductor wafers and other types of substrates used in the manufacture of integrated circuits, efforts are continually being made to optimize CMP processes. Meaningful CMP optimization must consider all factors that are significant in affecting the overall quality of CMP performance including uniformity, planarity, and pad conditioning and wear. Historically, uniformity has played the dominant role in modeling for CMP optimization. Although equally important, planarity has played a secondary role in such optimization. Modeling systems to simulate and predict the removal rate of features on semiconductor wafer surfaces polishing to achieve wafer-scale uniformity during the CMP process presently exist. There also exist modeling systems to simulate and predict the removal of small features to achieve feature-scale planarity during the CMP process. Even though pad conditioning and wear is an important CMP performance metric, accurately simulating and predicting pad degradation over time as not been included in prediction and optimization systems for CMP processes. No present wafer-scale uniformity or feature scale uniformity modeling system incorporates a pad conditioning and wear model that accurately simulates the physical properties that influence pad degradation. Therefore, there is no present system that uses wafer-scale uniformity and feature-scale planarity models along with a pad conditioning and wear model to improve wafer-scale uniformity and feature-scale planarity predictions and then utilizes those predictions to optimize the CMP process while achieving improvements in semiconductor wafer uniformity and planarity. In addition, no present system exists that use a pad conditioning and wear model in conjunction with the wafer-scale uniformity and feature-scale planarity models to predict pad performance and extend polishing pad life, thereby increasing the number of semiconductor wafers or other types of substrates that can be chemically-mechanically polished with one polish pad.

SUMMARY

The present invention is a method and system that uses wafer-scale uniformity and feature-scale planarity models along with a pad conditioning and wear model to improve wafer-scale uniformity and feature-scale planarity predictions. It then utilizes those predictions to optimize the CMP process to achieve improvements in semiconductor wafer uniformity and planarity. Use of the pad conditioning and wear model in conjunction with the wafer-scale uniformity and feature-scale planarity models can be used to predict pad performance and extend polishing pad life. Extending pad life results in an increase in the number of semiconductor wafers or other types of substrates that can be polished with one polishing pad. This can result in significant cost savings in the CMP process, both in reducing the number of pads needed and reduced time for pad replacement.

The pad conditioning and wear model computes and predicts the polishing effectiveness of each point on the pad based on how much polishing that point has performed. The pad conditioning portion of the model computes the thickness and roughness of the pad as a function of time and position on the pad. The kinematics and pressure applied during conditioning is used to compute the amount of pad material removed at each point. The pressure distribution between the pad and wafer is modeled in the pad conditioning and wear model. The total force pushing down on the wafer carrier is known, and the resulting pressure distribution between the pad and the wafer may be computed using any of a number of existing wafer-pad pressure distribution models. The thickness of the pad is determined by the change in the two pad layers over time. As the top layer is roughened during the conditioning process, the top layer becomes thinner and less stiff. As the base layer is compressed due to the pressure by the wafer on the pad, the base layer becomes thinner and increasingly stiff. The pad wear portion of the model computes the pad's roughness, which is represented by a Preston's coefficient, k, that varies with time and position on the pad. The pad conditioning portion of the model computes pad thickness, represented by h, which is also a function of time and position on the pad. The pad conditioning model also computes the restoration of the pad's roughness along with its decrease in thickness.

A wafer scale uniformity model predicts the material removed at each point by using an enhanced Preston equation. Unlike models using the traditional Preston equation, the enhanced version uses the Preston coefficient, k, representing the roughness of the pad which is computed in the pad wear model and varies with time and position on the pad. When polishing first begins, each point on the pad starts with an initial value for k. As polishing proceeds, the k value at each point is decreased depending on the amount of polishing performed by that point. In so doing, the uniformity model now captures the semiconductor wafer material rate drop-off commonly observed in CMP processes A feature-scale planarity model predicts the erosion of features on semiconductor wafer surfaces using the pad thickness, h, computed in the pad conditioning model that varies with time and position on the pad. The material removal rate predicted by the wafer-scale uniformity model is used to determine the erosion rate coefficient, E, used in the feature-scale planarity model. When polishing first begins, the top and base pad properties for each point on the pad start with an initial value. The thickness of the pad is computed in the pad conditioning and wear model and is determined by the change in the two pad layers over time. Using the pad thickness and roughness computed in the pad conditioning model, the feature-scale planarity model predicts how changes in the top pad thickness and base pad compressibility affect planarity of the wafer and polishing pad life.

The present invention is a computer implemented method for modeling, predicting and optimizing a Chemical Mechanical Polishing (CMP) system for polishing semiconductor wafers and other types of substrates used in the manufacture of integrated circuits. Polishing pad and semiconductor wafer and substrate parameters are input, a set of pad sampling points on a CMP polish pad is defined, and the CMP hardware configuration and CMP system recipe settings are simulated. A pad wear and conditioning model that predicts the polishing effectiveness of each sampling point on the polish pad based upon the polishing pad and substrate parameters, the pressure and speed between the wafer and the polish pad, and on the amount of polishing the point has performed in the simulated CMP hardware configuration using the CMP system recipe settings is defined. The pad conditioning and wear model determines the change in pad roughness for each sampling point on the pad using a pad wear model and determines the change in pad thickness for each sampling point on the pad using a pad conditioning model.

The pad roughness for each sampling point may be represented as a pad roughness variable. A set of wafer sampling points on a semiconductor wafer that corresponds to the set of pad sampling points is defined and the rate of material removed from the wafer at each wafer sampling point as a function of the pressure and relative speed between the wafer and the pad at that sampling point is predicted as a function of the pad roughness variable at that sampling point.

The pad conditioning model may also represent the polish pad as having a relatively stiff top pad planar surface connected to and located just above a relatively soft base pad planar surface having a thickness greater than the top pad planar surface. The change in the thickness of the top pad planar surface for each pad sampling point as a function of the polishing pad and substrate parameters, the pressure and speed between the wafer and the polish pad, the amount of conditioning performed on the top pad, and on the amount of polishing the pad sampling point has performed in the simulated CMP hardware configuration using the CMP system recipe settings is computed, and is used to determine the resulting thickness of the top pad planar surface for each sampling point. The change in thickness of the base pad planar surface as a function of the polishing pad and substrate parameters, the pressure and speed between the wafer and the polish pad, and the amount of polishing the pad sampling point has performed in the simulated CMP hardware configuration using the CMP system recipe settings is computed, and is used to determine the resulting thickness of the base pad planar surface for each sampling point. The resulting thickness of the top pad planar surface and the base pad planar surface is used to compute a pad thickness variable for each sampling point. The predicted change in thickness is used to compute a pad roughness variable, which represents the roughness of each pad sampling point as a function of the polishing pad and substrate parameters, the pressure and speed between the wafer and the polish pad, the amount of conditioning performed on the top pad planar surface, and on the amount of polishing the pad sampling point has performed in the simulated CMP hardware configuration using the CMP system recipe settings.

A set of wafer sampling points on a semiconductor wafer that corresponds to the set of pad sampling points may be defined. Using the pad roughness variable for each pad sampling point as computed in the pad wear model as an input to a uniformity model, the material removal rate of the material removed from the surface of a semiconductor wafer at each wafer sampling point is predicted. The method may further comprise inputting pre-polish wafer topography data, defining a set of wafer sampling points on a semiconductor wafer that correspond to the set of pad sampling points, and using the pad thickness variable for each pad sampling point as computed in the pad conditioning model and the material removal rate computed in the uniformity model as an input to a planarity model for predicting the erosion of features on a semiconductor wafer at each wafer sampling point.

The polish pad may be represented as having a relatively stiff top pad planar surface connected to and located just above a relatively soft base pad planar surface with a thickness greater than the top pad planar surface. The change in the thickness of the top pad planar surface for each pad sampling point as a function of the polishing pad and substrate parameters, the pressure and speed between the wafer and the polish pad, the amount of conditioning performed on the top pad, and the amount of polishing the pad sampling point has performed in the simulated CMP hardware configuration using the CMP system recipe settings is predicted.

The pad wear model may also calculate a minimum roughness value for the top pad planar surface of the polish pad, which represents the top pad's minimum effectiveness in removing material from a semiconductor wafer during the CMP process. A maximum roughness value for the top pad planar surface of the polish pad, which represents the top pad's maximum effectiveness in removing material from a semiconductor wafer during the CMP polishing process is also determined. An effective roughness value for each sampling point is set to the maximum roughness value upon polish process initiation. The conditioning process performed on the top pad planar surface to increase the effective roughness value when the roughness value is less than the maximum roughness value and greater than or equal to the minimum value is simulated. The effective roughness value for each pad sampling point as it changes during the CMP process and conditioning process is then predicted and updated. The simulation of the conditioning process may further comprise computing a polish wear model for each sampling point as a function of a pad degradation rate multiplied by the effective roughness value for each pad sampling point, times the rate the at work is done on the top pad planar surface by the wafer, where the rate at which work is done is a function of the pressure and speed between the wafer and the polish pad for each sampling point during the polishing process. The polish wear model is used to calculate the effective roughness value for each sampling point by computing the difference between the maximum roughness value and the minimum value as a function of the rate at which work is done, and the pad degradation rate over time summed with the minimum effective roughness value. The pad degradation rate is set to zero when the pad sampling point is not under the wafer.

The pressure distribution between the pad and the wafer is computed and the pressure between the wafer and the polish pad for each sampling point is set to the pressure distribution when the pad is contact with the wafer The pad conditioning process may also be modeled by using a pad restoration rate times the effective roughness value for each sampling point minus the maximum roughness value, times the rate that work is done on the top pad surface by the wafer where the rate at which work is done is a function of the pressure and speed between the wafer and the polish pad for each sampling point during the polishing process.

In another preferred embodiment, the computer implemented method for modeling, predicting and optimizing a Chemical Mechanical Polishing (CMP) system for polishing semiconductor wafers and other types of substrates used in the manufacture of integrated circuits comprises inputting polishing pad and semiconductor wafer and substrate parameters; defining a set of pad sampling points on a CMP polish pad; simulating the CMP hardware configuration and inputting CMP system recipe settings; using pressure and speed between the wafer and the polish pad; and defining a pad wear and conditioning model that predicts the polishing effectiveness of each sampling point on the polish pad based upon the polishing pad and substrate parameters, the pressure and speed between the wafer and the polish pad, and on the amount of polishing the point has performed in the simulated CMP hardware configuration using the CMP system recipe settings. The pad conditioning and wear model determines the change in pad roughness for each sampling point on the pad using a pad wear model and the change in pad thickness for each sampling point on the pad using a pad conditioning model. Pre-polish wafer topography data is input. A set of wafer sampling points on a semiconductor wafer that correspond to the set of pad sampling points is defined. The pad roughness for each pad sampling point as computed in the pad wear model is input to a uniformity model for predicting the material removal rate for the material removed from the surface of a semiconductor wafer at each wafer sampling point. The pad thickness variable for each pad sampling point as computed in the pad conditioning model and the material removal rate computed in the uniformity model is input to a planarity model for predicting the erosion of features on a semiconductor wafer at each wafer sampling point. The method may also optimize pad life and determining an optimal CMP recipe setting. The steps of optimizing pad life and determining the optimal recipe setting may comprise entering performance requirements for uniformity, planarity and throughput; forming an optimal recipe solution; modeling the polishing of a set of wafers predicting uniformity, planarity, pad wear, pad conditioning and pad thinning; performing the forming and modeling steps above until the model is not within the performance requirements entered; determining the number of wafers polished and forming a new optimal recipe solution. This process is repeated beginning with the modeling step above until the optimal recipe solution converges and then the optimal recipe is saved. The entering of performance requirements for uniformity, planarity and throughput may be by a user through a graphical user interface or they may be input from a previous pad conditioning and wear model system result. The planarity model may be a two or three dimensional model.

The predicted erosion of features and predicted material removed from a semiconductor wafer at each sampling point to predict polish pad wear and determine optimal CMP system parameters including the optimal pad parameters, optimal frequency of pad conditioning, geometry of the CMP hardware configuration and CMP recipe settings may be used to optimize polish pad life. The optimal settings to enhance polish pad life may include changing polish pad material properties; changing the polish pad parameters; determining an optimal frequency of conditioning the top pad to maintain constant uniformity; changing the CMP process recipe settings; and varying the simulation of the CMP hardware configuration. Changing the CMP process setting step may include varying the pressure between the pad and the wafer during polishing and varying the speed between the pad and the wafer during polishing. The optimal settings to enhance polish pad life may be input into the pad conditioning and wear model, uniformity model and planarity model to predict the uniformity and planarity of the wafer after the CMP process.

The pad wear and conditioning method may also predict the decay in material removal rate during the CMP polish process and determine the optimal conditioning frequency of the pad to roughen its surface and restore the pad's original material removal rate, and determining the optimal time of pad replacement. Optimizing pad life may also include determining an optimal roughness of the polish pad to both extend pad life and achieve a predetermined uniformity of the wafer after the CMP process. Optimizing pad life may further include determining an optimal top pad stiffness and base pad compressibility to both extend pad life and achieve a predetermined planarity of the wafer during the CMP process.

BRIEF DESCRIPTION OF THE DRAWINGS

These and other features, aspects and advantages of the present invention will become better understood with regard to the following description, appended claims and accompanying drawings where:

DETAILED DESCRIPTION OF THE DRAWINGS

Figure 1:
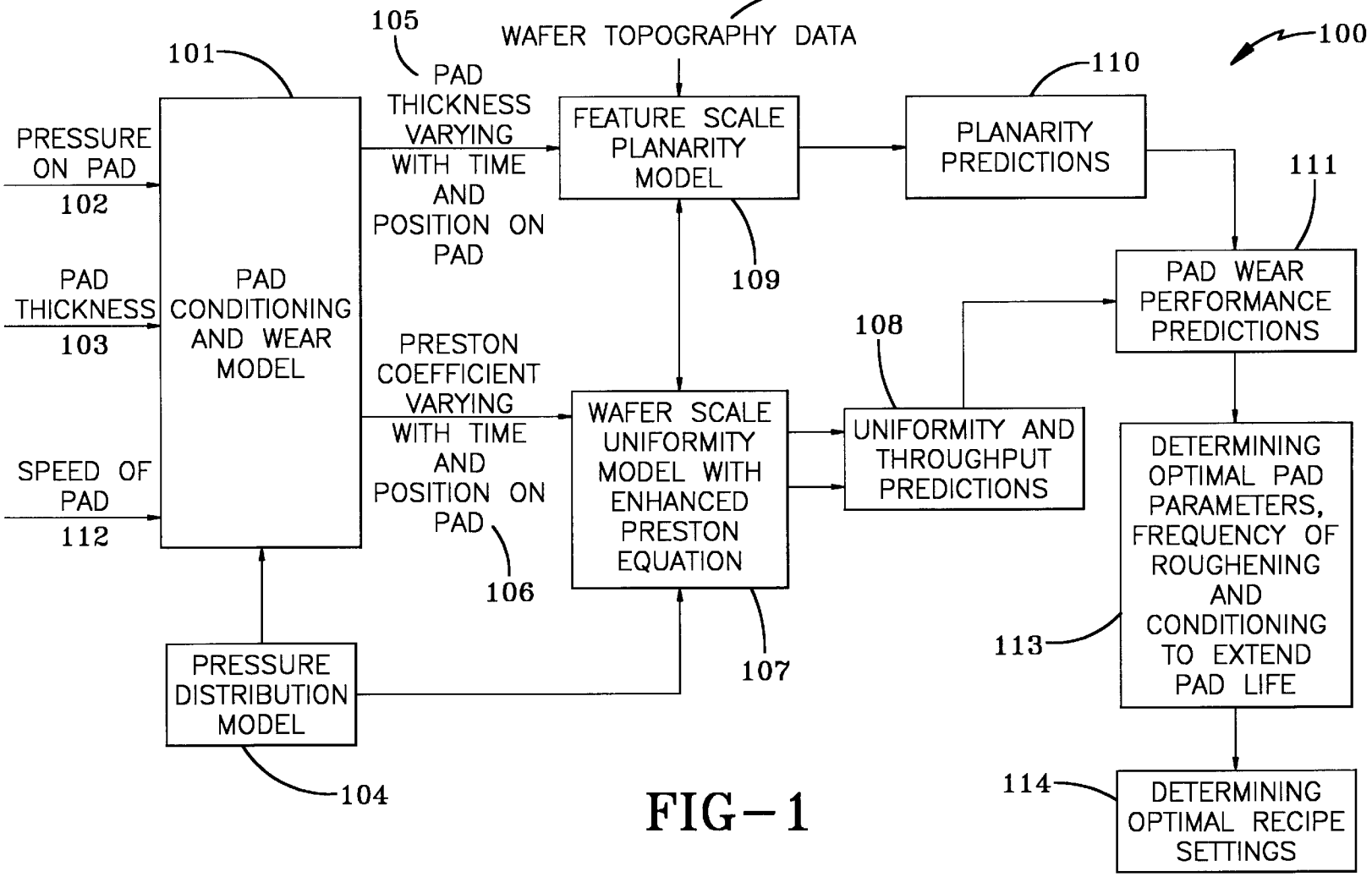
FIG. 1 is a system block diagram of the system of modeling, predicting and optimizing Chemical Mechanical Polishing (CMP) pad wear and extending pad life.
Figure 2A:
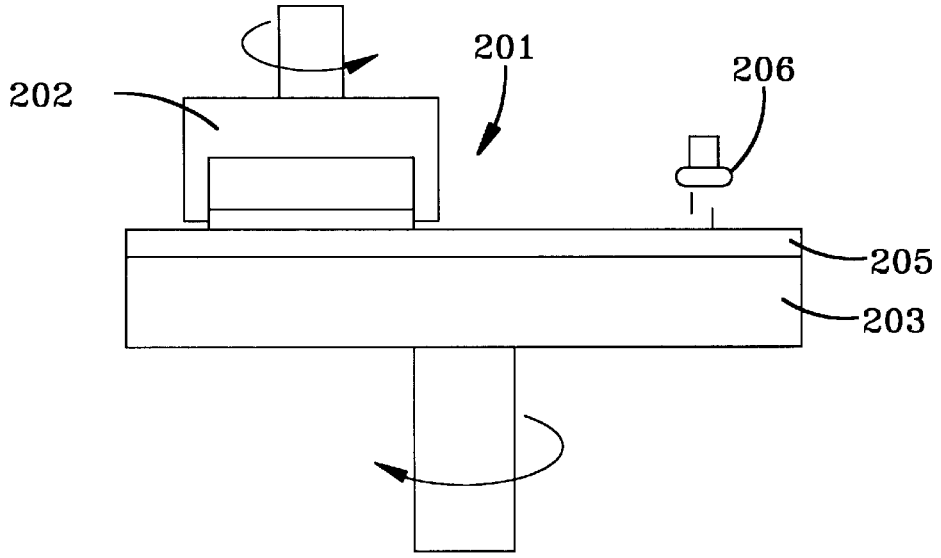
FIG. 2A is a side view of a typical Chemical Mechanical Polishing (CMP) tool configuration.
Figure 2B:
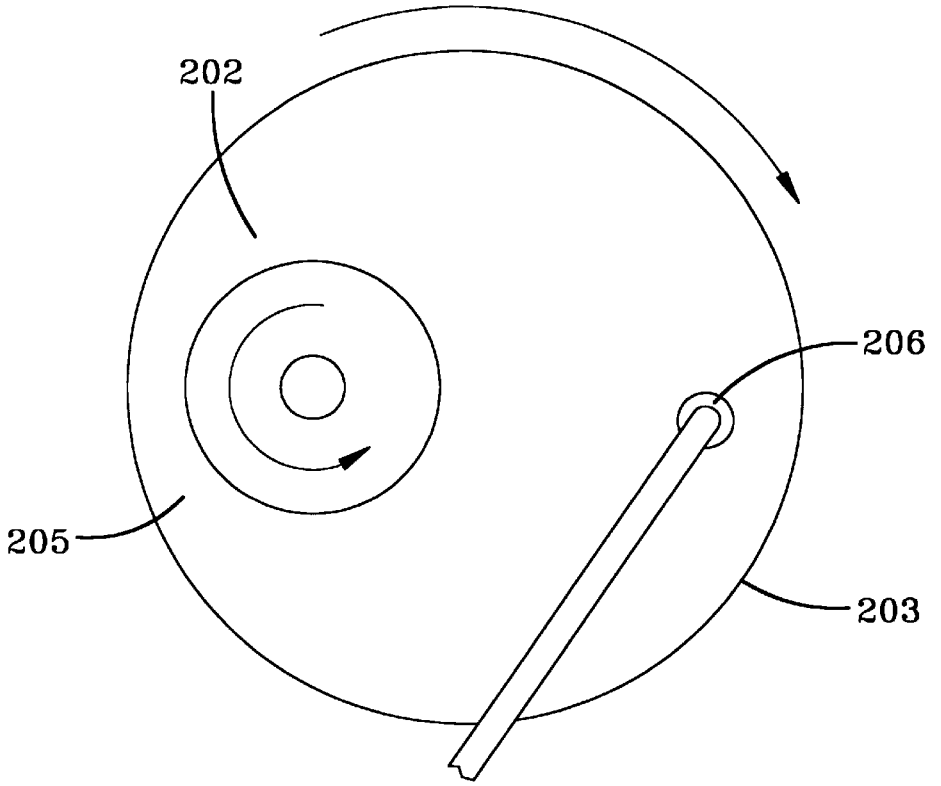
FIG. 2B is a top view of a typical Chemical Mechanical Polishing (CMP) tool configuration.

FIG. 1 shows a system block diagram of the system of modeling, predicting and optimizing CMP pad wear and extending pad life. The pad conditioning and wear modeling system 100 contains a pad conditioning and wear model 101 that adjusts the polishing effectiveness of each point on the pad based on how much polishing that point has performed. The pressure on the pad 102, pad thickness 103, and rotational speed of the pad 112 are input into the pad conditioning and wear model. Pressure distribution between the pad and wafer is modeled 104. The pressure on the pad 102 depends upon whether the pad is being conditioned or is polishing the wafer. When the pad is polishing the wafer, the pressure on the pad is equal to the pressure distribution 104 The pad conditioning portion of the model 101 computes top pad thickness and base pad compressibility to determine the thickness and roughness of the pad as a function of time and position on the pad. The model also tracks the amount of loading on the base pad to compute its increase in stiffness over time. The kinematics, or geometric properties of the pad and CMP tool configuration (which is shown in FIGS. 2A and 2B), rotational speed of the pad and pressure distribution during conditioning is used to compute the amount of pad material removed at each point. The pad wear portion of the model 101 computes the change in pad roughness due to wear on the pad by the wafer and conditioning of the pad. The roughness is represented by a Preston's coefficient that varies with time and position of the pad. The outputs of the pad conditioning and wear model are the pad thickness 105, represented by h, and roughness, Preston's coefficient 106, represented by k, which are both functions of time and position on the pad.

The pressure distribution model 104 predicts the pressure distribution for a wafer being pressed against a polishing pad. Any type of pressure model may be used. In its simplest form, pressure distribution between the pad and a wafer may be modeled as $$P = \frac{\text{Force}}{\text{Area}}$$

where the pressure distribution is equal to the downward force of the wafer against the pad over the pad area. Other models can be used, such as the finite element method model, which isolates the effects of the deformation of the edges of the polish pad on pressure distribution. In the finite element method model for a wafer pressed uniformly against the pad, the normal pressure is uniform under the wafer except within one millimeter of the edge where the pressure increases significantly. The output of the pressure distribution model is a pressure distribution value that is used by the pad conditioning and wear model 101 and the wafer scale uniformity model 107.

A wafer scale uniformity model 107 predicts the material removed at each point on the wafer using an enhanced Preston equation. Unlike models using the traditional Preston equation, the enhanced version uses a Preston coefficient 106, k, computed in the pad wear model, that represents pad roughness and varies with time and position on the pad. Pressure distribution on the wafer 104 is also input to the wafer scale uniformity model. When the simulation of the polishing process first begins, each point on the pad starts with an initial value for k. As polishing proceeds, the k value at each point is decreased depending on the amount of polishing performed by that point. In so doing, the uniformity model now captures the semiconductor wafer material rate drop-off commonly observed in CMP processes and calculates uniformity predictions 108. Based on other calculations in the wafer scale uniformity model, throughput for the CMP process is also predicted 108.

A feature-scale planarity model 109 predicts the erosion of features on semiconductor wafer surfaces using the pad thickness 105, h, computed in the pad conditioning model that varies with time and position on the pad and an erosion rate coefficient E, that varies with position on the pad (and is linked to Preston's coefficient), and stiffness of both the top and base pad Pre-polish topography data 113 is input to the model to simulate the topography of unpolished wafers. When polishing first begins, the top and base pad properties for each point on the pad start with an initial value. It is known that the stiffness of the top pad is a function of its thickness cubed. It is also known that the base pad compressibility changes with loading. Using the top pad thickness and base pad compressibility computed in the pad conditioning model, the feature-scale planarity model predicts how changes in the top pad thickness and base pad compressibility along with the loading history of the base pad affect planarity 110 and influence pad life.

The pad wear performance predictions 111 use the uniformity and planarity model results, along with the pad conditioning and wear model results to predict pad wear and determine pad life. This is used to optimize pad life in the CMP process 113. Optimization may be accomplished in various ways. Pad conditioning and wear performance predictions can be used to optimize pad life by changing the initial pad thickness, including the top pad stiffness or base pad compressibility; by determining the optimal time to roughen or condition the pad to maintain more constant uniformity results; and by determining the optimal frequency of conditioning of the pad to extend pad life. In addition, CMP process recipe settings may be varied 114, such as changing the pressure or speed settings of the tool configuration or varying the geometric configuration of the CMP polish tool such as the pad inner/outer radii and the sweep arm. After optimization has determined various pad parameter changes and optimal recipe settings, the new parameters and settings can be input to the pad conditioning and wear modeling system 100 to repeat the process and determine new uniformity, planarity and throughput predictions based upon the new configuration to further optimize and extend pad life. Optimization allows the user to select any of these variables to vary and to repetitively exercise the pad conditioning and wear modeling system 100.

FIG. 2A is a side-view of a typical Chemical Mechanical Polishing (CMP) tool configuration. FIG. 2B is a top view of a typical Chemical Mechanical Polishing (CM P) tool configuration. In the CMP process, the wafer 201 is affixed to a wafer carrier 202 and pressed face-down on a rotating platen 203 holding a polishing pad 205. A slurry feed 206 containing an abrasive material held in suspension is dripped onto the rotating platen 203 during polish. The carrier 202 and the platen 203 rotate at variable speeds, typically on the order of thirty (30) rpm. The tool configuration shown in FIGS. 2A and 2B shows a single-wafer polish tool configuration. Other configurations for polishing multiple wafers exist.

Figure 3:
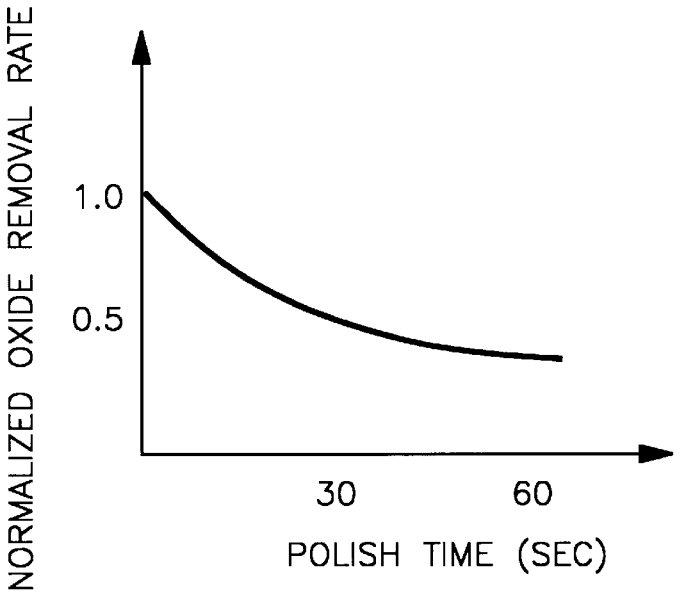
FIG. 3 depicts the decay in the wafer material removal rate with polishing time.

FIG. 3 depicts the decay in material removal rate with polishing time. It is known that the material removal rate provided by a polish pad decreases exponentially with time in the manner depicted in FIG. 3. As a consequence, the polish pad (205 in FIG. 2B) must be redressed or "conditioned" between polish cycles. Doing so roughens the surface of the pad 205 and restores, at least temporarily, its original material removal rate. When the pad 205 can no longer be reconditioned, it must be replaced.

Figure 4:
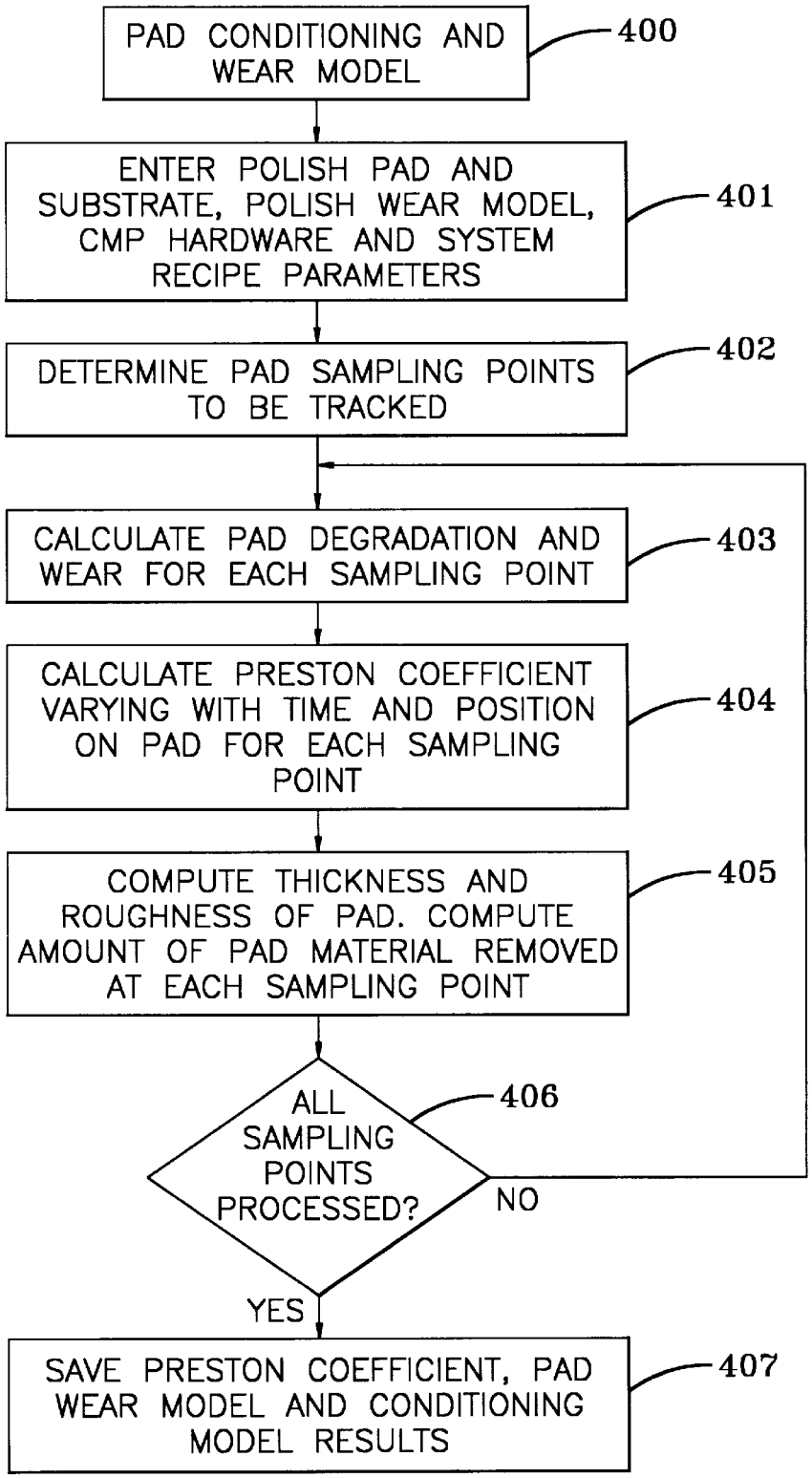
FIG. 4 is a flowchart representing the pad wear and conditioning model.

A flowchart representing the pad conditioning and wear model is shown in FIG. 4. In the pad conditioning and wear model, k (the Preston coefficient), is allowed to vary as the pad is conditioned because the conditioning process restores roughness. k also is allowed to vary due to the amount of polishing performed at each point on the pad. The wear and re-conditioning of the pad process is modeled:

$$k=k(x,y,t)$$

The Preston coefficient that varies with time and position on the pad is then input to the wafer scale uniformity model to form an enhanced Preston equation that calculates wafer uniformity and throughput predictions. Turning now to FIG. 4, processing starts in the pad conditioning and wear model 400 by entering polishing pad and substrate parameters, pad wear model parameters, the number of wafer polish heads, geometric configuration of the polisher tool, and conditioning down force, pressure distribution between the pad and wafer, along with any other information needed by the model 401.These values may be input from storage or may be entered by the user via a graphical user interface to the pad conditioning and wear model program. The values may also be determined by previous pad conditioning and wear model system results. Optimization allows the user to select any of these variables to vary and to repetitively exercise the pad conditioning and wear modeling system 100 as shown in FIG. 1. Minimum and maximum effectiveness values of the pad represented by $k_g$ and $k_c$, respectively are two of the parameters needed to be input to the model.

To develop the equations that describe how k changes, it is first assumed that there is an inherent minimum effectiveness of the pad that can be measured. Its minimal effectiveness is represented by a minimum value of k, denoted here as $k_g$, the g subscript denoting "glazed". It is also assumed that there is an inherent maximum effectiveness of the pad that can be measured just after proper conditioning. The maximum value of k, which represents the maximum effectiveness, is denoted here as $k_c$, the c subscript denoting "conditioned". By conditioning the pad, its effectiveness is enhanced and that increase is therefore represented by an increase in k. The amount of enhancement is the difference between k and its minimum value, i.e., $k(x,y,t)-k_g$. If $k(x,y,t)=k_g$, the pad is completely glazed meaning that no further wear is possible and the pad is no longer effective. Likewise, if $k(x,y,t)=k_c$ the pad is fully conditioned and further conditioning does not improve the pad's effectiveness.

The pad sampling points to be tracked over time are determined 402. This process is described in further detail in the discussion concerning FIG. 5, below. The closer k(x,y,t) is to its maximum value $k_c$, the more easily it is reduced when in contact with the wafer. Likewise, the closer k(xmy, t) is to its minimum value, the slower it is reduced when in contact with the wafer. Based on these arguments, the following pad wear model is developed and used to calculate pad degradation and wear 403. For a point $(x_p,y_p)$ on the pad, let $$\frac{dk(x_p, y_p, t)}{dt} = -D_p[k(x_p, y_p, t) - k_g]P(x_p, y_p, t)S(x_p, y_p, t)$$

where $D_p$ represents the pad degradation rate and is an adjustable model parameter. The above model attempts to relate the rate at which the pad is degraded (−dk/dt) to its current enhanced effectiveness $(k(x,y,t)-k_g)$ times the rate that work (~PS) is done on its surface by the wafer. The next step is to calculate the Preston coefficient, k, that varies with time and position on the pad 404. Note that for the special case (fixed point $x_p,y_p$) under constant wear at pressure P and speed S, starting with an initial value of $k=k_c$, the following closed-form solution for calculating roughness which is represented by the Preston coefficient, k, that varies with time and position on the pad, results:

$$k(t)=k_g+(k_c-k_g)\exp[-P\cdot S\cdot D_p\cdot t]$$

which is of the same form as the data shown in FIG. 3.

Next the pad conditioning model is used to compute the thickness and roughness of the pad as a function of time and position on the pad 405. The kinematics and pressure applied during conditioning is used to compute the amount of material removed at each sampling point. If the pad is completely glazed, that is $k(x,y,t)=k_g$, then the rate at which it is conditioned is highest. As its effectiveness approaches the maximum value $k_c$, further conditioning does not help as much. Based on that simple argument, the conditioning is modeled as $$\frac{dk(x, y, t)}{dt} = -D_c[k(x, y, t) - k_c]P(x, y, t)S(x, y, t)$$

where $D_c$ represents the pad conditioning rate and is an adjustable model parameter. The pad thickness is modeled as $$\frac{dh(x, y, t)}{dt} = k_{abrade}P(x, y, t)S(x, y, t)$$

which states that the rate at which the pad material is removed is proportional to an abrasion constant times the local pressure and the relative velocity.

If all sampling points have been processed 406, the results of the pad and wear model simulations are saved 407. These results include the pad wear results, the Preston coefficient and the pad conditioning results that computes the thickness of the pad and the amount of material removed. If all sampling points have been processed throughout the pad conditioning and wear model 406, processing continues at step 403 until all sampling points are processed.

Figure 5:
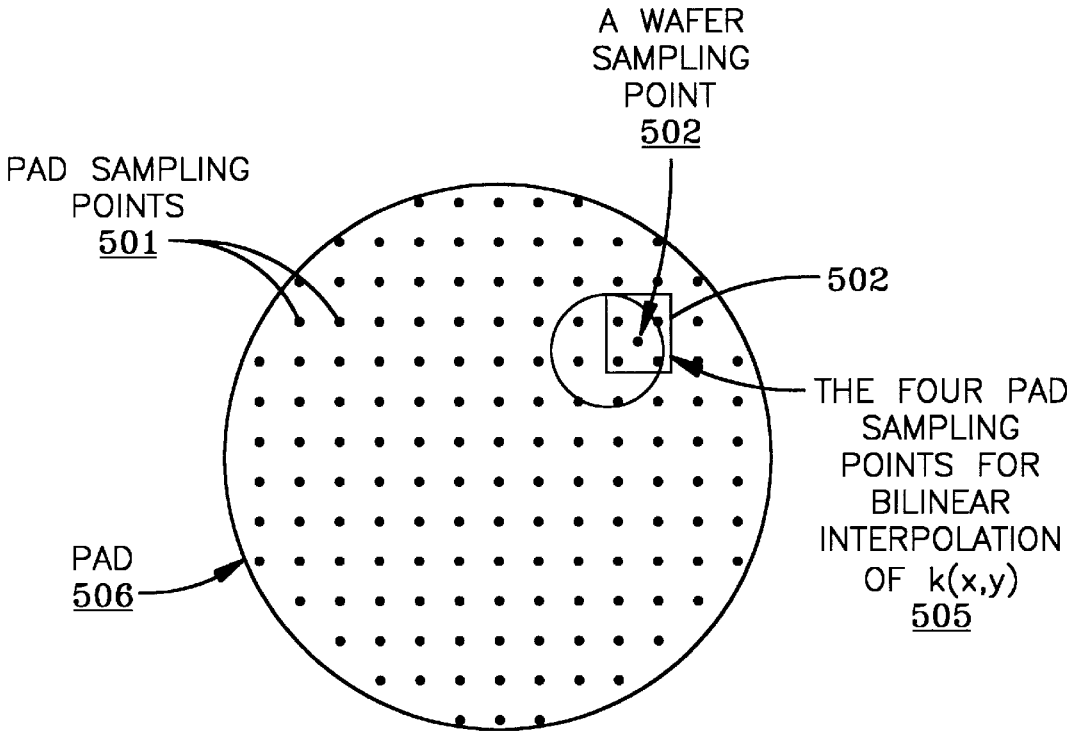
FIG. 5 depicts how the sampling points on a polish pad are interpolated to determine the Preston coefficient that varies with time and position on a pad at a wafer sampling point.

FIG. 5 shows how the sampling point on a polish pads are interpolated in the pad conditioning and wear model to determine the Preston coefficient that varies with time and position on a pad at a wafer sampling point. Turning now to FIG. 5, an array of points 501 on the pad surface 506 is established in a way similar to sampling points 502 of the wafer 503. The position and history of these pad sampling points 501 is tracked through time, integrating the degradation or restoration equations as they go. During polishing, the degradation model will be used. In a way analogous to modeling wafer overhang during Inside Diameter/Outside Diameter (ID/OD) processes, when a pad sampling point 501 is not under the wafer 503, its degradation rate will be dropped to zero by setting $D_p=0$ momentarily. During conditioning, the restoration model will be used. When a pad sampling point 501 is not under the conditioning device, its restoration rate will be dropped to zero by setting $D_c=0$ momentarily.

The Preston coefficient, the value k, which was once a constant, now becomes a value that is interpolated from the rotating grid of pad sampling points that lie below the wafer. For any wafer sampling point i, its x-y position determines four sampling points 505 from which bilinear interpolation provides a value for k. A search algorithm for finding the four local pad sampling points 505 and the bilinear interpolation routine for calculating the Preston coefficient is also included in the pad conditioning and wear model. The model calculates and saves the following information:

1.) The positions and current k values of the pad sampling point array.
2.) The number of wafers being polished and the motions of those wafers while being polished.
3.) The shape of the conditioning device and the conditioning recipe (kinematics and down-force).

The pad conditioning and wear model contains a graphical user interface for entering variable data that may be input by the user. The user is able to enter the following process information:

1.) Number of wafers heads running.
2.) Conditioner geometry and recipe.
3.) Parameters describing the pad wear and conditioning model, such as maximum and minimum pad effectiveness and pad roughness.

Figure 6:
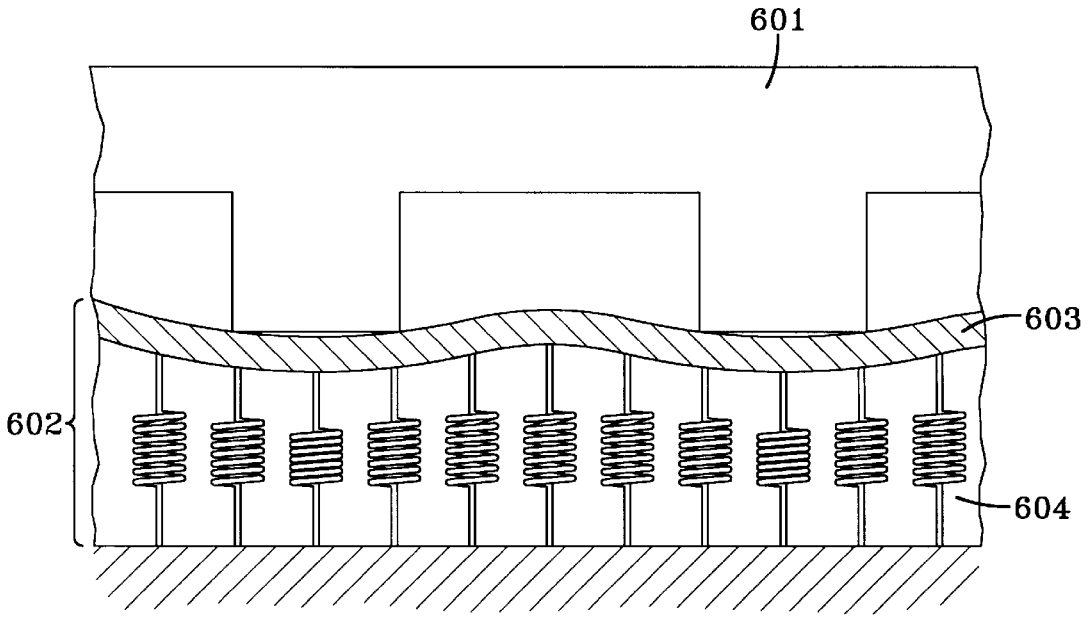
FIG. 6 is a cross-section view of the wafer placed face down on the polish pad during the CMP process.

The pad conditioning and wear model computes the thickness and roughness of the polish pad as a function of polish time and position on the pad. The kinematics and pressure applied during conditioning is used to compute the amount of pad material removed at each point. In FIG. 6, a wafer 601 is shown face down in contact with a polish pad 602 having a top pad area 603 that is relatively stiff and a base pad area 604 that is usually more compressible than the top pad 603. The base pad 604 compressibility changes as a function of loading. The top pad 603 stiffness is a function of its thickness cubed. The pad conditioning and wear model computes the top pad thickness and base pad compressibility as a function of time and position on the pad. The top pad stiffness and base pad compressibility as a function of time and position on the pad, along with the initial top and base pad properties such as thickness and base pad compressibility before polish action has occurred, are physical inputs for the feature scale planarity model, which predicts how the changes in the top pad thickness and base pad compressibility affect planarity, and hence, pad life.

Figure 7:
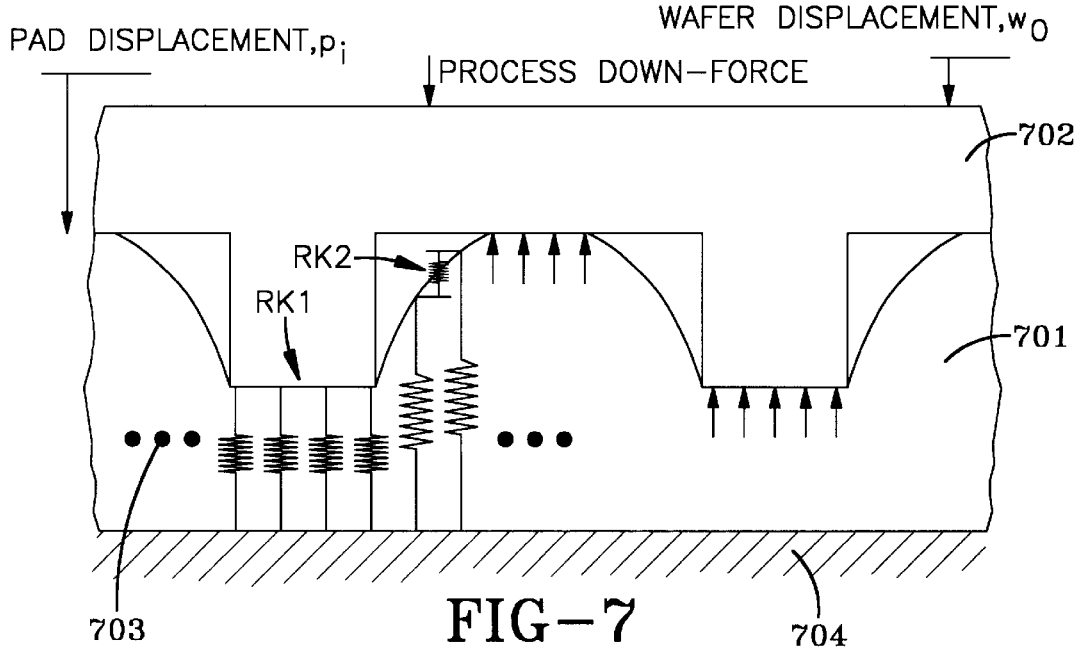
FIG. 7 is a cross-section view of the wafer and polish pad during the CMP process depicting the spring theory used in the planarity model to simulate erosion of the wafer.

FIG. 7 shows the planarity model that simulates erosion on the semiconductor wafer by computing the locally-varying force on the wafer by the pad. The erosion of features is equal to the erosion rate coefficient, computed from the Preston coefficient, times the local force applied by the pad 701. The local force applied by the pad 701 is determined by the local compression of the base pad times the flexural bending of the top pad. Both the top and bottom pads are represented as a series of springs. The pad 701 and the wafer 702 are discretized (broken up) into nodes (points) 703 and line segments 704 connecting them. Below each node 703 in the pad is a base spring of compressibility rk1. The base pad's compressibility is rk1. Below each node 703 in the spring is an auxiliary spring of compressibility rk2. The base pad's bending rigidity is represented by Hookian springs of strength rk2 that exert forces within in the pad in proportion to the difference in deflection times the thickness of the pad. At each step during the simulation, the planarity model determines the amount of wafer-pad contact by requiring a force balance of these springs rk1 and rk2 to be satisfied. Once the contact is determined, the force applied by each pad node 703 onto the associated wear node is used to calculate a material removal rate at that point. In this planarity model, top pad thickness and base pad compressibility as a function of time and position on the pad are input from the pad conditioning and wear model (as described in FIG. 6) to the planarity model. Prepolish wafer topography data is also input to the planarity model as an initial topography. The model can work from a high-resolution profilometer (HRP) scan to produce the initial topography or alternatively, arrays of rectangles that describe "up" features on the wafer may be entered by the user. The planarity model then uses the topography input data, top pad thickness and base pad compressibility and bulk rate data from the wafer scale uniformity model to predict the erosion and hence the planarity of the features on the wafer after the CMP process. Prior to the pad conditioning and wear model that determines pad thickness varying with time and position, the planarity model used a constant value, h, to represent the thickness of the polish pad and therefore did not account for variations in pad thickness over the life of the pad in predicting the planarity of the features of the wafer after the CMP process was completed.

The feature scale planarity model used in the present system is described above. Other types of planarity models currently exist. Any planarity model that predicts erosion on semiconductor wafers or other types of substrates and that can be modified to use changes in polish pad thickness at set sampling points on the pad as a function of time and position on the pad to determine planarity predictions can be substituted for the feature scale planarity model used in the present system.

The feature scale planarity model is physically based, and uses the top and base pad properties as direct physical inputs. It is known that the stiffness of the top pad is a function of its thickness cubed, It is also known that the base pad compressibility changes with loading. Using the feature scale planarity model in conjunction with the pad wear model, it is possible to predict how changes in the top pad thickness and the base pad compressibility affect planarity and therefore pad life. Prior to the pad conditioning and wear model, the feature scale planarity model described herein used a constant value for the thickness of the polish pad used in its linear equations for modeling spring force. Since the pad conditioning and wear model computes pad thickness, including top pad stiffness and base pad compressibility varying based upon the time and position of the pad, the feature scale model in the present invention now uses a this a pad thickness value for a set of sampling points that changes as a function of time and position on the pad in its linear equations for modeling spring force. This produces a more accurate prediction of planarity of the wafer after the CMP process is complete.

Figure 8:
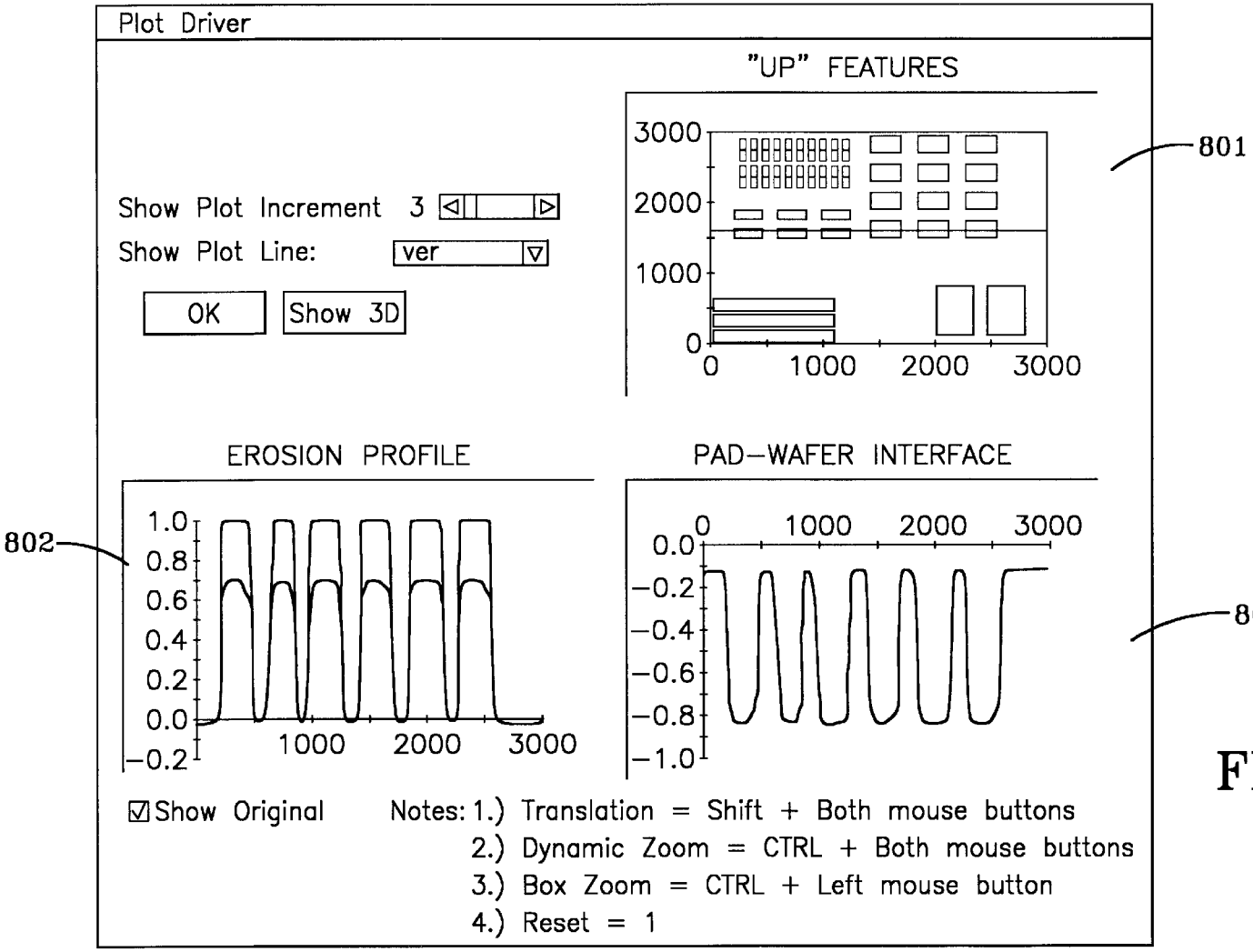
FIG. 8 depicts a typical display of the results of the planarity model.

FIG. 8 shows typical output displays of the feature scale planarity model used in the present invention. An overhead view of a plot of the pre-polish topography 801 is shown under the heading "Up" Features. The erosion profile 802 shows the predicted planarity results using a cross-sectional plot of the wafer surface. The pad-wafer interface 803 is shown as a cross-sectional plot of the wafer turned upside down and touching the pad, that is, as it actually appears to the pad.

The wafer-scale uniformity model 107 in FIG. 1, uses the enhanced Preston equation which represents pad roughness as a function of time and position on the pad to account for pad wear or conditioning. The uniformity model used in the present system is described below. Other types of uniformity prediction models currently exist. Any uniformity model that predicts the material removed at each point on the wafer, uses pad roughness as a input to determine those predictions, and can be modified to use changes in roughness, at set sampling points on the pad as a function of time and position on the pad, to determine wafer uniformity predictions can be substituted for the uniformity model used in the present system.

The wafer scale uniformity model used in the present invention states that the rate (R) at which material is removed at a point $(x_w,y_w)$ on the wafer is proportional to pressure (P) at that point and the relative speed (S) between the wafer and the pad at that point, i.e., $$R(x_w,y_w,t)=kP(x_w,y_w,t)S(x_w,y_w,t).$$

where k is the Preston coefficient computed in the pad conditioning and wear model that varies with time and position on the pad, $P(x_w,y_w)$ is the pressure at that point, and $S(x_w,y_w)$ is the relative speed between the wafer and pad at that point. Instead of using the bulk pressure, this slightly enhanced model uses a wafer-centered parabolic pressure distribution, described by the following equation:

$$P(r_w) \propto P_i - (P_i - P_o)\left(\frac{r_w}{R_{wafer}}\right)^2$$

where $r_w$ is the radial position on the wafer and $P_i$ is a parameter describing the pressure at the center of the wafer relative to the pressure $P_o$ at the wafer edge. By holding $P_o$ constant at 1 and varying $P_i$ and k as fitting parameters, the model is able to faithfully reproduce experimental results.

Figure 9:
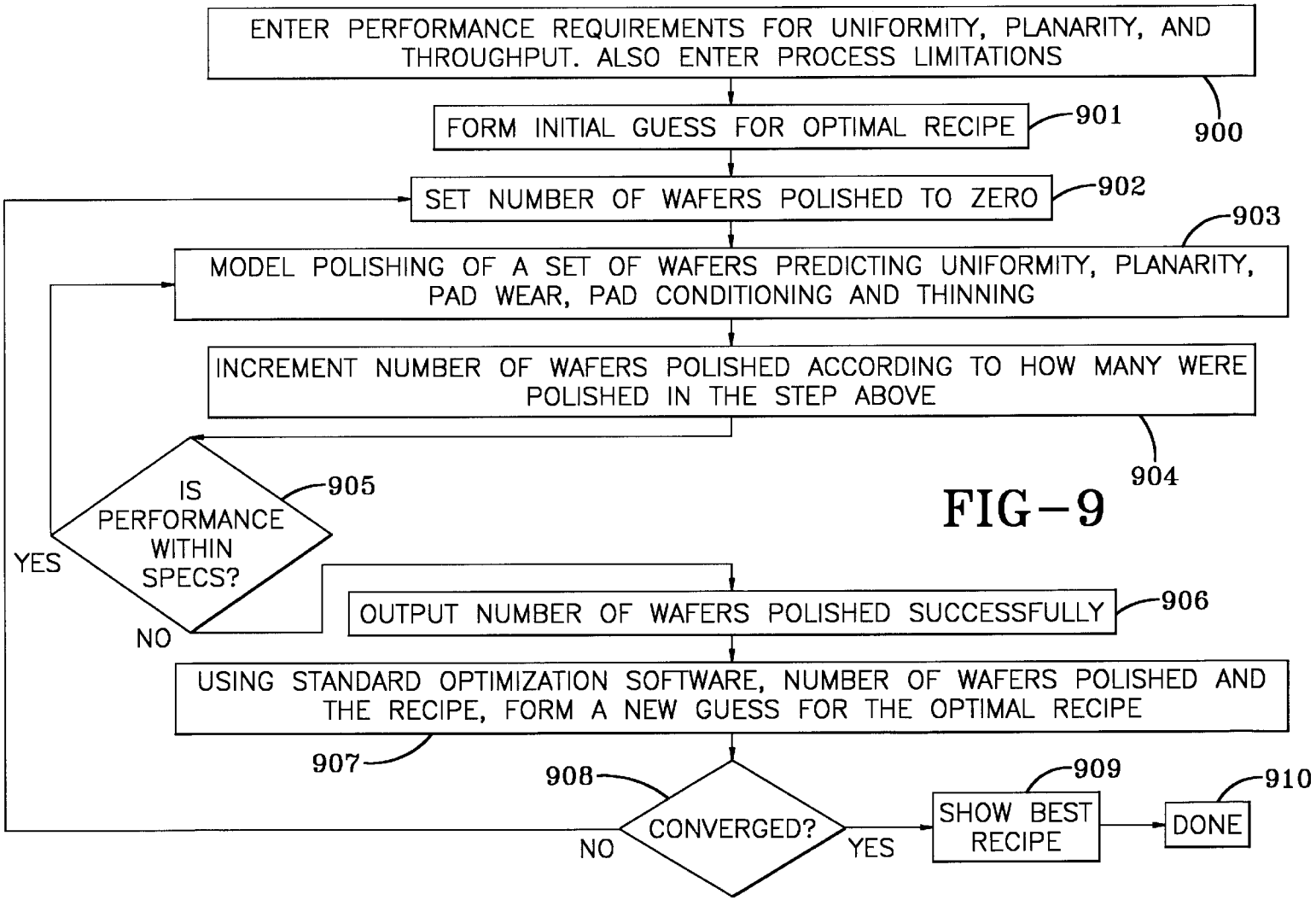
FIG. 9 is a flowchart representing pad optimization as performed in the pad wear and conditioning model.

FIG. 9 is a flowchart representing pad optimization and determining optimal recipe setting (114 in FIG. 1) as performed in the pad wear and conditioning model. Performance requirements for uniformity, planarity and throughput along with the process limitations are entered either by the user or from a database 900. The pad wear and conditioning model forms an initial guess for the optimal recipe 901. The number of wafers polished is set to zero 902 to indicate the initiation of the CMP process. The polishing of a set of wafers predicting uniformity, planarity, pad wear, pad conditioning and thinning is modeled 903 as shown in FIG. 1. The number of wafers polished is incremented and saved 904. If the pad wear performance predictions (111 in FIG. 1) are within the specifications of the performance requirements 905, the modeling is repeated (step 903) until the performance is not within the specifications. If the performance is not within the specifications, the number of wafer polished successfully is output 906. Using a standard optimization software application program, the number of wafers polished and the recipe used to polish the wafers, a new solution for the optimal CMP polishing recipe is made 907. If the solution converges 908, an optimal recipe has been found 909 and processing is complete 910. If the solution does not converge 908, processing continues at step 902 and repeats until an optimal recipe is found.

Although the present invention has been described in detail with reference to certain preferred embodiments thereof, other embodiments are possible. Therefore, the spirit and scope of the appended claims should not be limited to the description of the preferred embodiments herein.

What is claimed is:

1. A method for modeling, predicting and optimizing a Chemical Mechanical Polishing (CMP) system for polishing semiconductor wafers and other types of substrates used in the manufacture of integrated circuits, in a computer program running on a computer processor, the method comprising the steps of:

a. inputting polishing pad and semiconductor wafer and substrate parameters;

b. defining a set of pad sampling points on a CMP polish pad;

c. simulating the CMP hardware configuration and inputting CMP system recipe settings;

d. using pressure and speed between the wafer and the polish pad; and e. defining a pad wear and conditioning model that predicts the polishing effectiveness of each sampling point on the polish pad based upon the polishing pad and substrate parameters, the pressure and speed between the wafer and the polish pad, and on the amount of polishing the point has performed in the simulated CMP hardware configuration using the CMP system recipe settings, the model comprising i. determining the change in pad roughness for each sampling point on the pad using a pad wear model;

ii. determining the change in pad thickness for each sampling point on the pad using a pad conditioning model.

2. The method of claim 1 wherein pad roughness for each sampling point is represented as a pad roughness variable.

3. The method of claim 2, further comprising:

a. defining a set of wafer sampling points on a semiconductor wafer that correspond to the set of pad sampling points; and b. predicting the rate of material removed from the wafer at each wafer sampling point as a function of the pressure and relative speed between the wafer and the pad at that sampling point, and as a function of the pad roughness variable at that sampling point.

4. The method of claim 2, further comprising:

a. defining a set of wafer sampling points on a semiconductor wafer that correspond to the set of pad sampling points; and b. using the pad roughness variable for each pad sampling point as computed in the pad wear model as an input to a uniformity model, that predicts the material removal rate of the material removed from the surface of a semiconductor wafer at each wafer sampling point.

5. The method of claim 1, the pad conditioning model further comprising:

a. representing the polish pad as having a relatively stiff top pad planar surface connected to and located just above a relatively soft base pad planar surface having a thickness greater than the top pad planar surface;

b. predicting the change in the thickness of the top pad planar surface for each pad sampling point as a function of the polishing pad and substrate parameters, the pressure and speed between the wafer and the polish pad, the amount of conditioning performed on the top pad, and on the amount of polishing the pad sampling point has performed in the simulated CMP hardware configuration using the CMP system recipe settings, and determining the resulting thickness of the top pad planar surface for each sampling point;

c. predicting the change in thickness of the base pad planar surface as a function of the polishing pad and substrate parameters, the pressure and speed between the wafer and the polish pad, and the amount of polishing the pad sampling point has performed in the simulated CMP hardware configuration using the CMP system recipe settings, and determining the resulting thickness of the base pad planar surface for each sampling point; and d. using the resulting thickness of the top pad planar surface and the base pad planar surface to compute a pad thickness variable for each sampling point.

6. The method of claim 5, further comprising:

a. inputting pre-polish wafer topography data;

b. defining a set of wafer sampling points on a semiconductor wafer that correspond to the set of pad sampling points; and c. using the pad thickness variable for each pad sampling point as computed in the pad conditioning model and the material removal rate computed in the uniformity model as an input to a planarity model for predicting the erosion of features on a semiconductor wafer at each wafer sampling point.

7. The method according to claim 6, wherein the planarity model is a two-dimensional planarity model.

8. The method according to claim 6, wherein the planarity model is a three-dimensional model.

9. The method of claim 1, the pad wear model further comprising:

a. representing the polish pad as having a relatively stiff top pad planar surface connected to and located just above a relatively soft base pad planar surface with a thickness greater than the top pad planar surface;

b. predicting the change in the thickness of the top pad planar surface for each pad sampling point as a function of the polishing pad and substrate parameters, the pressure and speed between the wafer and the polish pad, the amount of conditioning performed on the top pad, and the amount of polishing the pad sampling point has performed in the simulated CMP hardware configuration using the CMP system recipe settings; and c. using the predicted change in thickness to compute a pad roughness variable, which represents the roughness of each pad sampling point as a function of the polishing pad and substrate parameters, the pressure and speed between the wafer and the polish pad, the amount of conditioning performed on the top pad planar surface, and on the amount of polishing the pad sampling point has performed in the simulated CMP hardware configuration using the CMP system recipe settings.

10. The method according to claim 9, further comprising predicting the throughput for the CMP process in the uniformity model.

11. The method according to claim 1, the pad wear model further comprising:

a. representing the polish pad as having a relatively stiff top pad planar surface connected to and located just above a relatively soft base pad planar surface with a thickness greater than the top pad planar surface;

b. determining a minimum roughness value for the top pad planar surface of the polish pad, which represents the top pad's minimum effectiveness in removing material from a semiconductor wafer during the CMP process;

c. determining a maximum roughness value for the top pad planar surface of the polish pad, which represents the top pad's maximum effectiveness in removing material from a semiconductor wafer during the CMP polishing process;

d. setting an effective roughness value for each sampling point to the maximum roughness value upon polish process initiation;

e. simulating the conditioning process performed on the top pad planar surface to increase the effective roughness value when the roughness value is less than the maximum roughness value and greater than or equal to the minimum value; and f. predicting and updating the effective roughness value for each pad sampling point as it changes during the CMP process and conditioning process.

12. The method according to claim 11, the simulating the conditioning process further comprising:

a. computing a polish wear model for each sampling point as a function of a pad degradation rate multiplied by the effective roughness value for each pad sampling point times the rate the at work is done on the top pad planar surface by the wafer; and b. the rate at which work is done is a function of the pressure and speed between the wafer and the polish pad for each sampling point during the polishing process.

13. The method according to claim 12, further comprising:

a. computing the pressure distribution between the pad and the wafer; and b. setting the pressure between the wafer and the polish pad for each sampling point to the pressure distribution when the pad is contact with the wafer.

14. The method according to claim 12 using the polish wear model to calculate the effective roughness value for each sampling point by computing the difference between the maximum roughness value and the minimum value as a function of the rate at which work is done, and the pad degradation rate over time summed with the minimum effective roughness value.

15. The method according to claim 14, further comprising setting the pad degradation rate to zero when the pad sampling point is not under the wafer.

16. The method according to claim 15, further comprising setting the pad restoration rate to zero when the pad sampling point is not under the conditioning device.

17. The method according to claim 11, further comprising:

a. modeling the pad conditioning process by using a pad restoration rate times the effective roughness value for each sampling point minus the maximum roughness value, times the rate that work is done on the top pad surface by the wafer; and b. the rate at which work is done is a function of the pressure and speed between the wafer and the polish pad for each sampling point during the polishing process.

18. A method for modeling, predicting and optimizing a Chemical Mechanical Polishing (CMP) system for polishing semiconductor wafers and other types of substrates used in the manufacture of integrated circuits, in a computer program running on a computer processor, the method comprising the steps of:

a. inputting polishing pad and semiconductor wafer and substrate parameters;

b. defining a set of pad sampling points on a CMP polish pad;

c. simulating the CMP hardware configuration and inputting CMP system recipe settings;

d. using pressure and speed between the wafer and the polish pad;

e. defining a pad wear and conditioning model that predicts the polishing effectiveness of each sampling point on the polish pad based upon the polishing pad and substrate parameters, the pressure and speed between the wafer and the polish pad, and on the amount of polishing the point has performed in the simulated CMP hardware configuration using the CMP system recipe settings, the model comprising i. determining the change in pad roughness for each sampling point on the pad using a pad wear model;

ii. determining the change in pad thickness for each sampling point on the pad using a pad conditioning model.

f. inputting pre-polish wafer topography data;

g. defining a set of wafer sampling points on a semiconductor wafer that correspond to the set of pad sampling points;

h. using the pad roughness for each pad sampling point as computed in the pad wear model as an input to a uniformity model for predicting the material removal rate for the material removed from the surface of a semiconductor wafer at each wafer sampling point; and i. using the pad thickness variable for each pad sampling point as computed in the pad conditioning model and the material removal rate computed in the uniformity model as an input to a planarity model for predicting the erosion of features on a semiconductor wafer at each wafer sampling point.

19. The method according to claim 18, further comprising optimizing pad life and determining an optimal CMP recipe setting.

20. The method according to claim 19, the steps of optimizing pad life and determining the optimal recipe setting further comprising:

a. entering performance requirements for uniformity, planarity and throughput;

b. forming an optimal recipe solution;

c. modeling the polishing of a set of wafers predicting uniformity, planarity, pad wear, pad conditioning and pad thinning;

d. performing steps b and c until the model is not within the performance requirements entered;

e. determining the number of wafers polished;

f. forming a new optimal recipe solution;

g. performing steps c through f until the optimal recipe solution converges; and h. saving the optimal recipe.

21. The method according to claim 20, wherein the entering of performance requirements for uniformity, planarity and throughput is by a user through a graphical user interface.

22. The method according to claim 20, wherein the entering of performance requirements for uniformity, planarity and throughput is from a previous pad conditioning and wear model system result.

23. The method according to claim 20, further comprising optimizing pad life by determining an optimal roughness of the polish pad to both extend pad life and achieve a predetermined uniformity of the wafer after the CMP process.

24. The method according to claim 20, further comprising optimizing pad life by determining an optimal top pad stiffness and base pad compressibility to both extend pad life and achieve a predetermined planarity of the wafer after the CMP process.

25. The method according to claim 19, further comprising using the predicted erosion of features and predicted material removed from a semiconductor wafer at each sampling point to predict polish pad wear and determine optimal CMP system parameters including the optimal pad parameters, optimal frequency of pad conditioning, geometry of the CMP hardware configuration and CMP recipe settings to optimize polish pad life.

26. The method according to claim 25, using the predicted polish pad wear to optimize pad life further comprising determining optimal settings to enhance polish pad life:

a. changing polish pad material properties;

b. changing the polish pad parameters;

c. determining an optimal frequency of conditioning the top pad to maintain constant uniformity;

d. changing the CMP process recipe settings; and e. varying the simulation of the CMP hardware configuration.

27. The method according to claim 26, the changing the CMP process setting step further comprises:

a. varying the pressure between the pad and the wafer during polishing; and b. varying the speed between the pad and the wafer during polishing.

28. The method according to claim 25 wherein the optimal settings to enhance polish pad life are input into the pad conditioning and wear model, uniformity model and planarity model to predict the uniformity and planarity of the wafer after the CMP process.

29. The method according to claim 25, further comprising:

a. predicting the decay in material removal rate during the CMP polish process;

b. determining the optimal conditioning frequency of the pad to roughen its surface and restore the pad's original material removal rate; and c. determining the optimal time of pad replacement.

* * * * *